US008261785B2

(12) United States Patent
Koga et al.

(10) Patent No.: US 8,261,785 B2
(45) Date of Patent: Sep. 11, 2012

(54) GRIPPER FOR AN AUTOMATIC BAG FILLING APPARATUS

(75) Inventors: Shoichi Koga, Iwakuni (JP); Kenji Kawamura, Iwakuni (JP)

(73) Assignee: Toyo Jidoki Co., Ltd, Tokyo (JP)

( * ) Notice: Subject to any disclaimer, the term of this patent is extended or adjusted under 35 U.S.C. 154(b) by 749 days.

(21) Appl. No.: 12/456,933

(22) Filed: Jun. 24, 2009

(65) Prior Publication Data

US 2009/0314386 A1 Dec. 24, 2009

(30) Foreign Application Priority Data

Jun. 24, 2008 (JP) ..... 2008-164822

(51) Int. Cl.
*B65B 43/46* (2006.01)

(52) U.S. Cl. ..... 141/114; 141/10; 141/314; 53/284.7; 53/469; 53/570

(58) Field of Classification Search ..... 141/10, 141/114, 313–314; 53/284.7, 459, 469, 570
See application file for complete search history.

(56) References Cited

U.S. PATENT DOCUMENTS

| | | | | |
|---|---|---|---|---|
| 4,263,768 | A * | 4/1981 | Russell et al. | 53/384.1 |
| 5,119,615 | A * | 6/1992 | Kujubu et al. | 53/573 |
| 5,182,898 | A * | 2/1993 | Tung et al. | 53/570 |
| 5,398,484 | A * | 3/1995 | Kader | 53/284.7 |
| 6,662,936 | B2 * | 12/2003 | Ikemoto et al. | 53/284.7 |
| 6,742,321 | B2 * | 6/2004 | Gates | 53/284.7 |
| 7,611,102 | B2 * | 11/2009 | Murray | 141/391 |
| 7,882,685 | B2 * | 2/2011 | Koga et al. | 53/570 |
| 2003/0217528 | A1 * | 11/2003 | Wilson | 53/284.7 |

FOREIGN PATENT DOCUMENTS

| | | |
|---|---|---|
| JP | S55-90506 | 6/1980 |
| JP | H5-28169 | 7/1993 |
| JP | H6-144403 | 5/1994 |
| JP | H7-18571 | 5/1995 |
| JP | 2002-302227 | 10/2002 |
| JP | 2005-320012 | 11/2005 |
| JP | 2007-210645 | 8/2007 |
| WO | WO 2007/049913 | 5/2007 |

* cited by examiner

*Primary Examiner* — Gregory Huson
*Assistant Examiner* — Nicholas A Arnett
(74) *Attorney, Agent, or Firm* — DLA Piper LLP (US)

(57) ABSTRACT

A gripper used in, for instance, a bag filling apparatus including a pair of gripper arms provided with chuck holders. Each chuck holder includes first and second tubular portions, first and second tubular members slidably inserted therein, and first and second air cylinders installed within the tubular portions. An inside fixed chuck element is affixed to the tip end of the first tubular member, and an inside movable chuck element is attached to the tip end of the piston rod of the first air cylinder; in addition, an outside fixed chuck element is affixed to the tip end of second tubular member, and an outside movable chuck element is attached to the tip end of the piston rod of the second air cylinder; and the movable chuck elements are opened and closed with respect to the fixed chuck elements by the advance and retreat motions of the respective piston rods.

9 Claims, 7 Drawing Sheets

GRIPPER FOR AN AUTOMATIC BAG FILLING APPARATUS

BACKGROUND OF THE INVENTION

1. Field of the Invention

The present invention relates to a gripper used in an automatic bag filling apparatus in which a plurality of pairs of grippers are provided at equal intervals around a periphery of a transportation member that rotates continuously or intermittently so that each pair of grippers grip two locations on either side edge of a gusset bag and is rotated along a predetermined circular path along with the transportation member.

2. Related Art

An intermittently rotating table type bag filling apparatus, for instance, is equipped with a table that rotates intermittently and a plurality of pairs of grippers that are installed around the periphery of the table at equal intervals and rotated intermittently together with the table. In this bag filling apparatus, during one rotation of the table, one gusset bag is supplied to the grippers, and the filling process that includes opening of the bag, filling of the bag with contents, and, if necessary, sealing of the bag mouth, is performed with the gusset bag being gripped at its both side edges by the grippers and hanged from the grippers.

An example of this type of bag filling apparatus gripper is disclosed in, for instance, Japanese Patent Application Laid-Open (Kokai) No. 2007-210645. This bag filling apparatus gripper includes grippers equipped with pairs of left and right gripper arms swingably mounted on an intermittently rotating table, chuck holders that are rotatably mounted on the gripper arms and make a translational motion (movement in parallel) upon the swing motion of the gripper arms so that the chuck holders narrow and widen the space in between, an inside chuck section and an outside chuck section which are respectively comprised of a fixed chuck element and a movable chuck element and provided to face each other at the tip end portion of each chuck holder, chuck open/close mechanisms that open and close the inside and outside chuck sections, and a chuck positioning mechanism that move the inside and outside chuck sections inwardly and outwardly between a close position and a separate position.

However, these grippers have several problems.

(1) Since the structure of the grippers, particularly the structure of the chuck open/close mechanism, is complex, this complexity increases the costs and makes cleaning and maintenance more difficult.

(2) When changing the position of process (bag supply, removal of filled bag and other processes) or adding process (a re-holding and weighing process) in which the chucks are opened and closed, a drive mechanism (chuck open/close bar) to activate the chuck open/close mechanism of the grippers in that process location must be installed; however, the drive mechanism therefor must be linked mechanically (via a cam or the like) to the main (i.e., rotating table) drive mechanism, and this makes design changes and/or modifications difficult.

(3) When the inside and outside chuck sections are moved apart from each other (so as to open the bag), the chucks cannot be released structure-wise, it is impossible to employ a re-holding and weighing process that requires opening and closing of the chucks.

(4) It is desirable to vary the gripping force of the chucks depending on the material and thickness of the bag and depending on the amount of material to be filled in the bag; however, it is extremely difficult to adjust the gripping force by a lock pin, and even the skilled technicians, it takes quite some time to do this.

Japanese Utility Model Application Publication (Kokoku) No. H7-18571, Japanese Patent Application Laid-Open (Kokai) No. 2005-320012, and Japanese Utility Model Application Laid-Open (Kokai) No. S55-90506 disclose grippers that are installed around an intermittently rotating transportation member (table or endless chain). However, all of these grippers have the same problems as those of (1) and (2) described above. In addition, though it is desirable to change the gripping force of the chucks according to, for instance, the bag material and thickness and to the amount of material to be filled, the grippers of these three (3) relevant art provide the gripping force of the chucks by a spring bias force, and it is necessary to change the spring if the gripping force is desired to change. However, since a large number of springs (four for each gripper) are used, replacing the springs is extremely laborious and takes time even for the skilled technicians.

BRIEF SUMMARY OF THE INVENTION

Accordingly, it is an object of the present invention to provide grippers used in, for instance, an automatic bag filling apparatus in which the grippers for gusset bags, though similar to the grippers described in Japanese Patent Application Laid-Open (Kokai) No. 2007-210645, have a simple structure and are able to allow the chuck sections to be opened and closed at any position.

It is another object of the present invention to provide grippers in which a position where a process that involves opening and closing of the chuck sections can be moved easily in an automatic bag filling apparatus and such process can be easily added to the filling apparatus, and further the gripping force of the chuck sections can be changed easily when required.

The above objects are accomplished by a unique structure of the present invention for an improvement in the grippers used in an automatic bag filling apparatus, wherein a plurality of pairs of grippers are provided at equal intervals around a periphery of a transportation member that rotates continuously or intermittently, and the plurality of pairs of grippers respectively grip a gusset bag at two locations on either side edge thereof and are rotated along a predetermined circular path together with the transportation member;

each pair of the grippers being comprised of:

a pair of left and right gripper arms swingably mounted on the transportation member, chuck holders rotatably mounted respectively on the gripper arms and are moved in parallel when the gripper arms make a swing motion so that a space between the chuck holders is narrowed and widened, inside chuck sections and outside chuck sections provided in the tip end portions of the chuck holders so to face each other, an inside chuck open/close mechanism and an outside chuck open/close mechanism provided in each one of the chuck holders and respectively open and close the inside and outside chuck sections, and an inside/outside chuck positioning mechanism provided in each one of the chuck holders and moves the inside chuck section and outside chuck section inwardly and outwardly between a close position and a separate position; and wherein the inside chuck section comprise an inside fixed chuck element, having a gripping surface facing inward, and an inside movable chuck element, so that the inside fixed and movable chuck elements grip one of the two locations on the side edge of the gusset bag in between; and the outside chuck section comprises an outside fixed chuck element, having a gripping surface facing outward, and an outside movable chuck element, so that the outside fixed and movable chuck elements grip another one of the two locations on the side edge of the gusset bag in between.

In the above and following descriptions, the term "inside" (or "inward") used for individual chuck section refers to a side that faces toward the transportation member (table), while the term "outside" (or "outward") refers to a side that faces opposite therefrom. Also, the "left-side" is the left-hand side in FIG. 5 and the "right-side" is the right-hand side in FIG. 5

In the above structure, the improvement according to the present invention includes that:

the inside chuck open/close mechanism is comprised of:
- a first tubular member slidably provided within each of the chuck holders, and
- a first air cylinder installed within the tube body of the first tubular member; and the inside movable chuck element which is affixed to the tip end of the first tubular member is opened and closed with respect to the inside fixed chuck element by the advance and retreat motions of the piston rod of the first air cylinder; and the outside chuck open/close mechanism is comprised of:
- a second tubular member slidably provided within the above-described each of the chuck holders, and
- a second air cylinder installed within the tube body of the second tubular member, and the outside movable chuck element which is affixed to the tip end of the second tubular member is opened and closed with respect to the outside fixed chuck element by the advance and retreat motions of the piston rod of the second air cylinder.

Furthermore, in the improvement of the present invention:

the inside chuck open/close mechanism can be comprised of:
- a first tubular member slidably provided within each of the chuck holders, and
- a first air cylinder that uses the first tubular member as a cylinder tube thereof; and the inside movable chuck element which is affixed to the tip end of the first tubular member is opened and closed with respect to the inside fixed chuck element by the advance and retreat motions of the piston rod of the first air cylinder; and the outside chuck open/close mechanism can be comprised of:
- a second tubular member slidably supported on the above-described each of the chuck holders, and
- a second air cylinder that uses the second tubular member as a cylinder tube thereof, and the outside movable chuck element which is affixed to the tip end of the second tubular member is opened and closed with respect to the outside fixed chuck element by the advance and retreat motions of the piston rod of the second air cylinder.

The above-described grippers may take the following specific format:

(1) each of the chuck holders has a first tubular portion and a second tubular portion, the first tubular member is slidably provided within the first tubular portion, and the second tubular member is slidably provided within the second tubular portion;

(2) the air cylinder is a double-acting air cylinder; and (3) the transportation member is an intermittently rotating table, and each pair of grippers grips the gusset bag in a hanging state, and in addition during one rotation of the table, a gusset bag is supplied to each pair of grippers, and a filling process including opening of the bag mouth and filling of the bag with contents is performed sequentially for the gusset bag gripped by the grippers.

As seen from the above, according to the grippers of the present invention, the structure of the gripper, which is like one described in Japanese Patent Application Laid-Open (Kokai) No. 2007-210645 is simple, and in particular, the structure of the chuck open/close mechanisms and chuck positioning mechanisms is simplified, which lowers the costs and improves the performance with respect to the cleaning and maintenance of the bag filling apparatus. In addition, a process (re-holding and weighing of a bag, for instance) that involves opening and closing of the chuck sections can be moved easily at any location on the transportation member (intermittently rotating table) when necessary, and further the gripping force of the chuck sections can be changed easily as necessary.

DETAILED DESCRIPTION OF THE INVENTION

The grippers and improvements therein for an automatic bag filling apparatus according to the present invention will be described in detail below with reference to the FIGS. 1 through 6.

Overall Structure of Bag Packaging Apparatus

Figure 1:
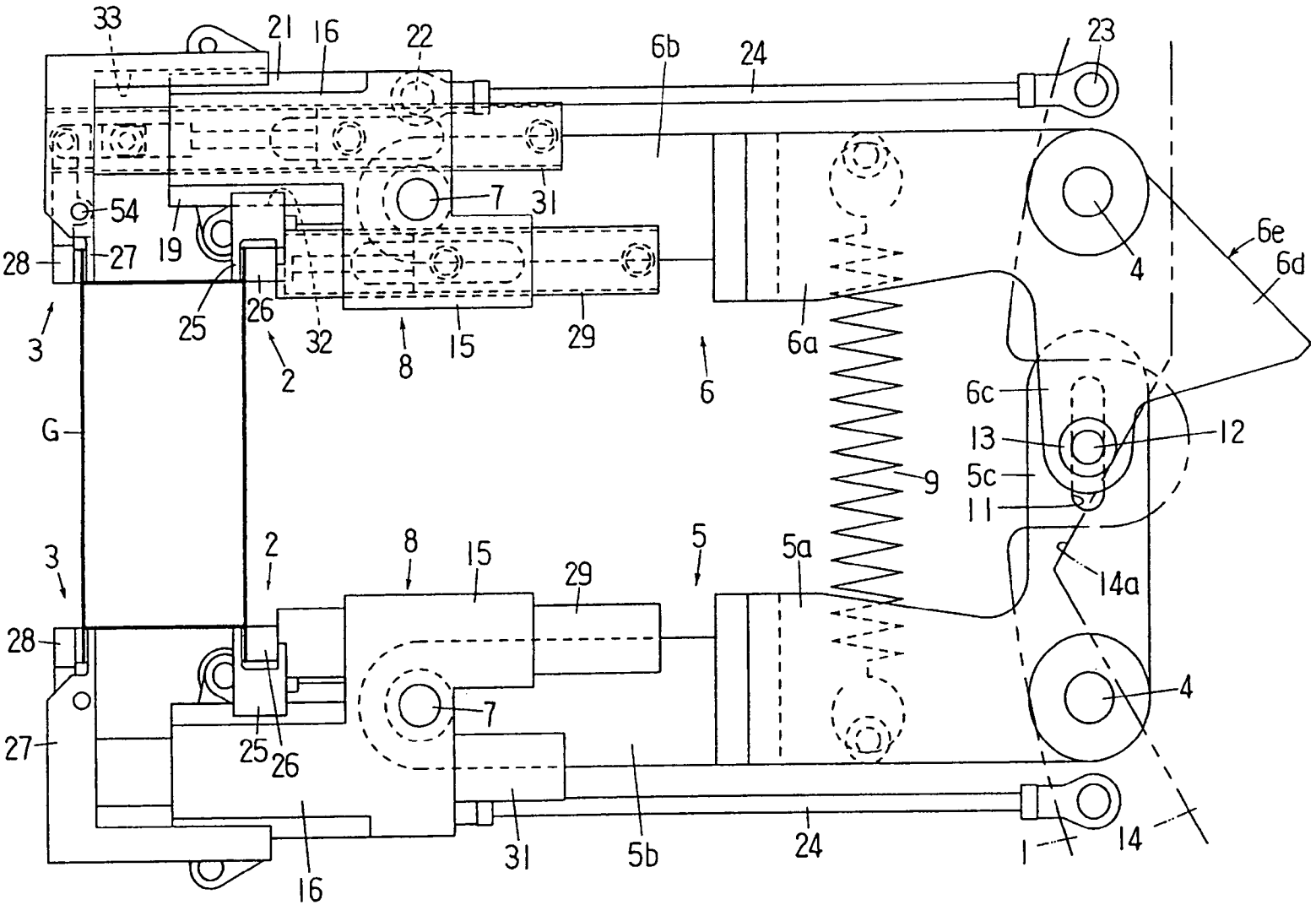
FIG. 1 is a top view of the gripper according to the present invention (with the inside and outside chuck sections separated from each other)

The grippers of the present invention are, as primarily shown in FIG. 1, installed on the periphery of an intermittently rotating table (only a part thereof shown) 1 of an intermittently rotating table type bag filling apparatus. A plurality of pairs of grippers are provided at equal intervals around the table 1, and each pair of grippers grip both side edges of a gusset bag G at, as seen from FIG. 1, two locations, inside and outside, on either side of the gusset bag G; and thus each pair of grippers has two sets of chuck sections comprising inside chuck sections 2 and outside chuck sections 3 so that two inside chuck sections 2 face each other, and two outside chuck sections 3 face each other.

Though not shown in the drawings, at each one of the processing positions around the table 1 (locations where the grippers make a stop) is provided a bag supply and half-opening device (at a bag supply position), a printing device (at a printing position), a contents supply device (at a filling position), a bag mouth sealing device (at a sealing position), a cooling-seal device (at a cooling position) and so on; and these filling operations are performed sequentially each time the grippers make a stop.

Structure of Grippers

Each one of the plurality of pairs of grippers comprises a pair of gripper arms 5 and 6 and chuck holders 8 provided on the respective gripper arms 5 and 6. The right-side gripper arm 5 and the left-side gripper arm 6 are respectively mounted on supporting shafts 4 affixed to the table 1 so that the gripper arms are horizontally rotatable about the supporting shafts 4. The gripper arm 5 is comprised of a first arm 5*a* and a second arms 5*b* affixed to the first arm 5*a*, and the gripper arm 6 is likewise comprised of a first arm 6*a* and a second arm 6*b* affixed to the first arm 6*a*. Each one of the plurality of pairs of grippers has chuck holders 8 which are provided on supporting shafts 7 affixed to the tip ends of the gripper arms 5 and 6 so that the chuck holders 8 are horizontally rotatable about the supporting shafts 7.

Each one of the gripper arms 5 and 6 is provided with the above-described chuck sections 2 and 3 together with mechanisms that respectively open and close the chuck sections and a mechanism that positions the chuck sections 2 and 3 close to each other and separate from each other. The gripper arms 5 and 6 are urged inwardly to come closer to each other by a tension spring 9. The gripper arms 5 and 6, the chuck holders 8 and 8 mounted on their tip ends, the chuck sections 2 and 3, and the above-described mechanisms are disposed substantially symmetrically.

Gripper Arm Positioning Mechanism

Conventional technology (basically the same as that disclosed in Japanese Utility Model Application Publication (Kokoku) No. 1993-28169) is used for the gripper arm positioning mechanism that makes the gripper arms 5 and 6 swing within a horizontal plane to move them closer together and move them apart from each other (or to make open/close actions of them). That mechanism will be described below first briefly.

As seen from FIG. 1, the gripper arms 5 and 6 are respectively formed, near the supporting shafts 4, with plate-shaped engagement portions 5*c* and 6*c* so that these engagement portions face inwardly towards each other. An elongated hole 11 is formed in the engagement portion 5*c* of the gripper arm 5 so as to extend in the direction of the length of the engagement portion 5*c*, and an engagement shaft 12 is vertically provided in the engagement portion 6*c* of the gripper arm 6 and fitted in the elongated hole 11 of the gripper arm 5 so that the engagement shaft 12 can slide therein. A roller 13 is rotatably mounted on the top end of the engagement shaft 12. The gripper arm 6 is further formed near the supporting shaft 4 with an opening and closing part 6*d*.

As described in detail in the above-described Japanese Utility Model Application Publication (Kokai) No. 1993-28169, a cylindrical cam (not shown) that can be raised and lowered (for the height adjustable purposes) is installed under the table 1, and a cam roller (not shown) that travels on the top surface of the cylindrical cam is mounted on one end of an L-shaped lever (not shown) that is swingably provided via a shaft on a bracket (not shown) affixed to the underside of table 1; and in addition, an open/close roller (not shown) is provided on the other end of the L-shaped lever. The center of the cylindrical cam coincides with the rotational center of the table 1 and is rotated at the same angle by being synchronized to the intermittent rotation of the table 1, so that and when the table I stops, the cylindrical cam is rotated the same angle in reverse to return to its original position.

The active side 6*e* formed on the opening and closing part 6*d* of the gripper arm 6 is pushed against the open/close roller by the urging force of the spring 9. When the cylindrical cam is rotated in reverse, the cam roller rolls along the top surface of the cylindrical cam to be moved up and down, and as a result, the open/close roller swings via the L-shaped lever; and since the active side 6*e* of the opening and closing part 6*d* of the gripper arm 6 is being pushed against the open/close roller, the gripper arm 6 swings in the horizontal plane. Furthermore, since the engagement shaft 12 of the grip arm 6 is engaged with the elongated hole 11 of the gripper arm 5, the gripper arm 5 swings almost symmetrically at the same time with respect to the gripper arm 6, so that the gripper arms 5 and 6 are moved closer to each other and apart from each other (thus making an open/close action in the horizontal plane).

As seen from FIG. 1, a planetary cam 14 is provided above the table 1 so that it can rotate (and thus the circumferential position can be adjusted). The center of the planetary cam 14 coincides with the rotational center of the table 1. When the above-described cam roller rolls along the top surface of the above-described cylindrical cam and is moved down, the above-described open/close roller retreats, and as a result, the gripper arm 6 and the gripper arm 5 swing inwardly and become closer to each other (making the closing action). The swing motion of the gripper arms 5 and 6 stops when the roller 13 contacts the catching side 4*a* of the planetary cam 14; and at this moment, the gripper arms 5 and 6 are in the close position.

The position where the circumferential position of the planetary cam 14 is set determines the close position of the gripper arms 5 and 6 (which is also the close position of the chuck sections 2 and 3), and the position where the height position of the above-described cylindrical cam is set determines the separate position of the gripper arms 5 and 6 (which is also the separate position of the chuck sections 2 and 3). Accordingly, by adjusting the two positions of the planetary cam 14 and cylindrical cam, it is possible to adjust the opening and closing range of the gripper arms 5 and 6 (in other word, the close and separate positions of the gripper arms 5 and 6); in other words, it is possible to adjust the opening and closing range of the chuck sections 2 and 3 (in other words, the close and separate positions of the chuck sections 2 and 3).

The circumferential position of the planetary cam 14 and the height position of the cylindrical cam are adjusted according to the width (top-to-bottom direction in FIG. 1) of the gusset bag G.

Chuck Holders and Parallel Link Mechanism

Figure 3:
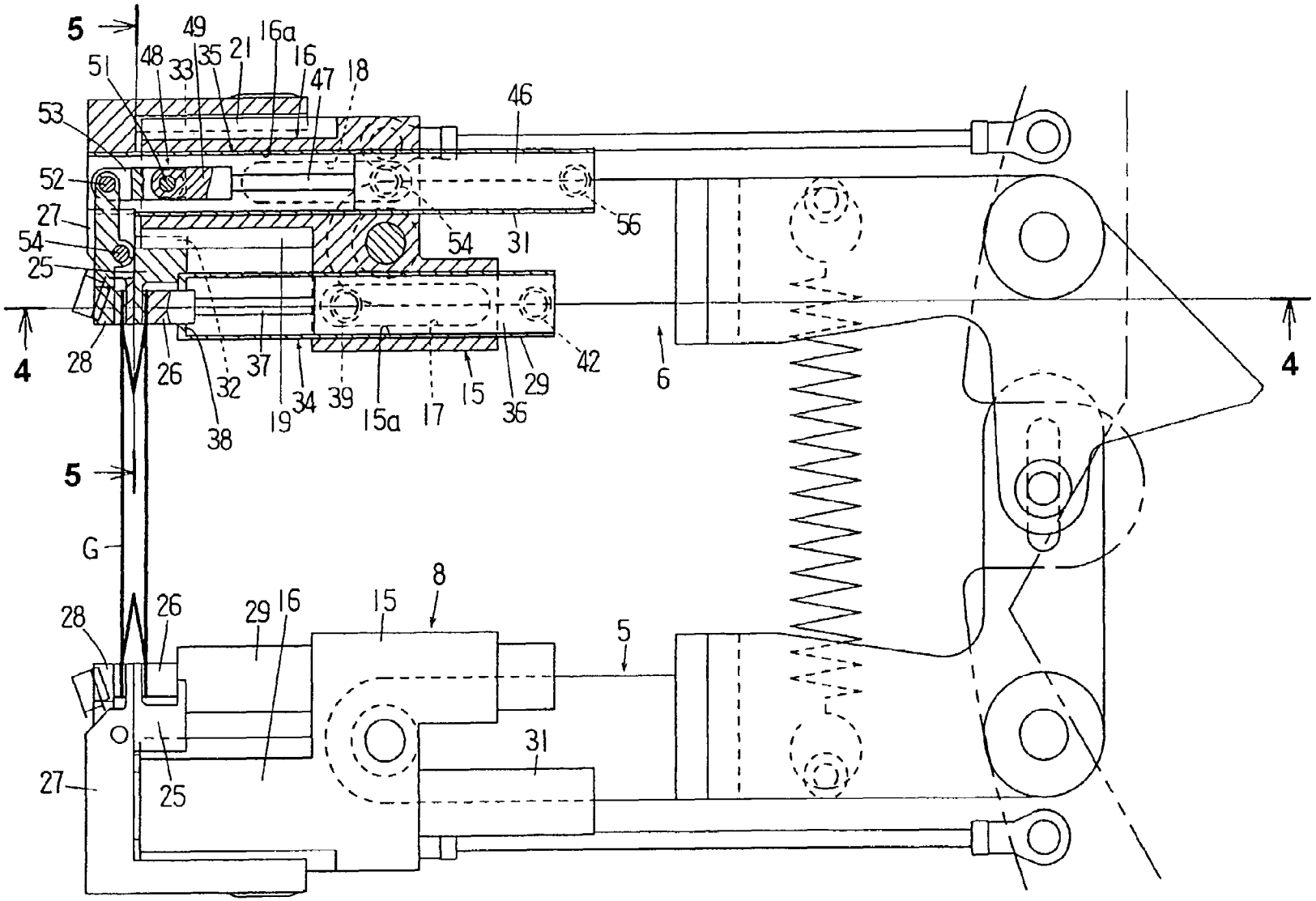
FIG. 3 is a cross-sectional view at taken along the line 3-3 in FIG. 2 (with the left-side gripper arm (shown in the upper half in FIG. 3) in cross-section)
Figure 4:
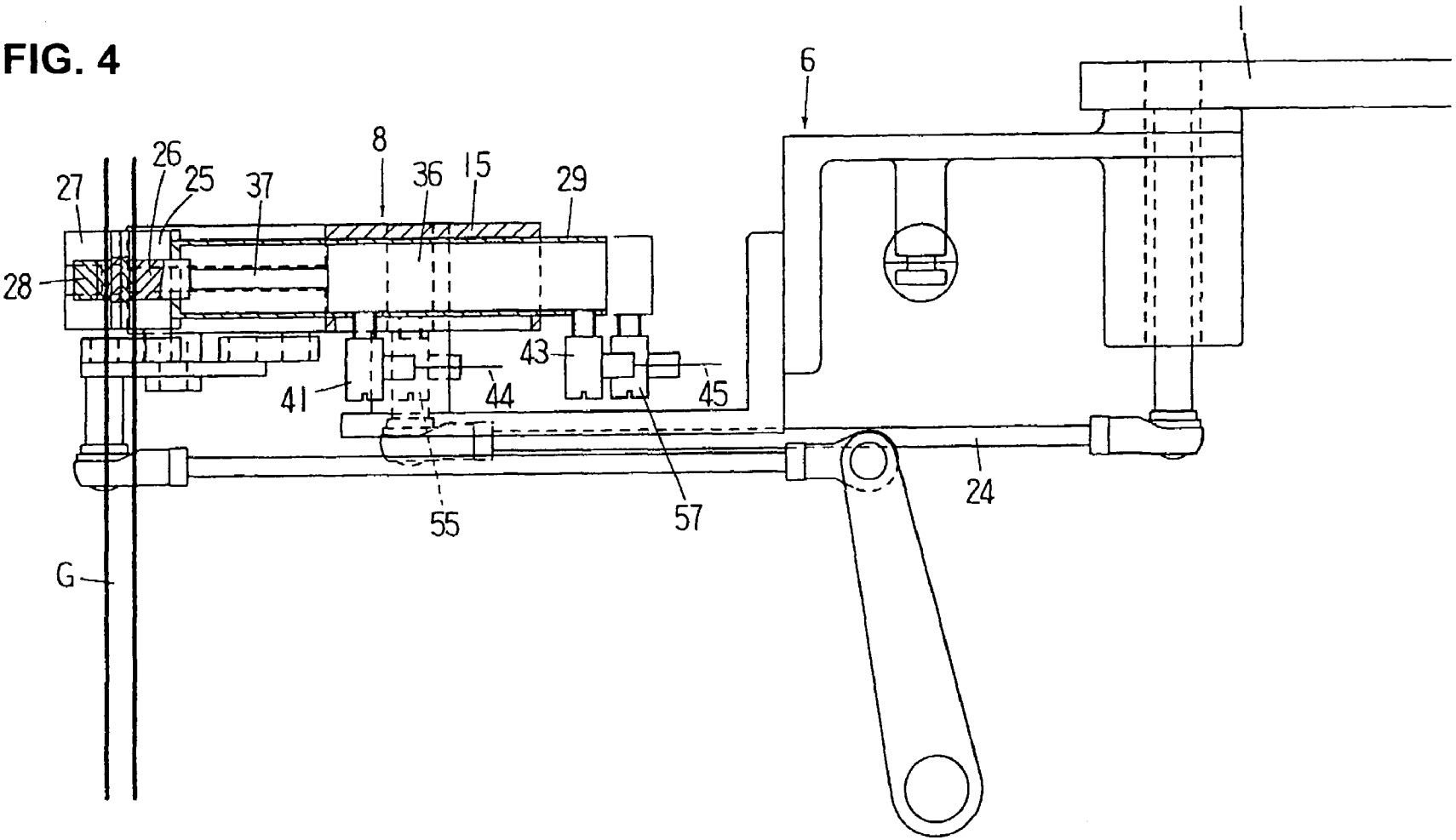
FIG. 4 is a cross-sectional view taken along the line 4-4 in FIG. 3.
Figure 5:
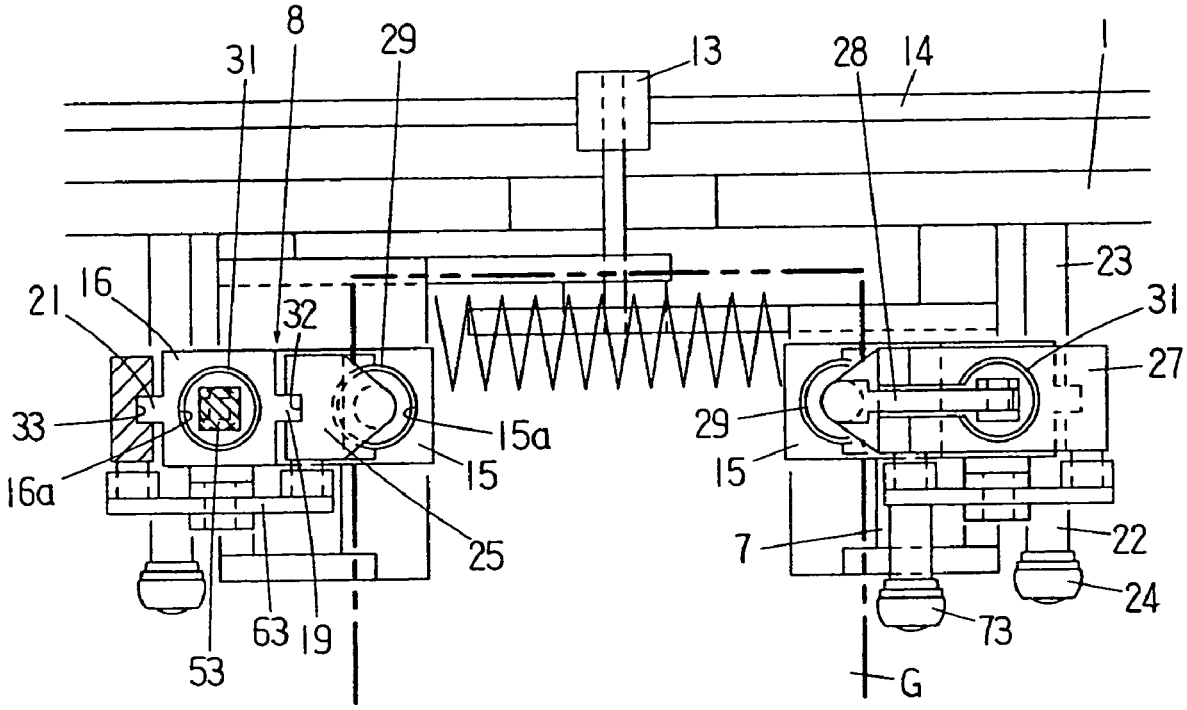
FIG. 5 is a cross-sectional view taken along the line 5-5 in FIG. 3.

Each of the chuck holders 8, as best seen from FIGS. 3 and 5, is comprised of a first tubular portion 15 and a second tubular portion 16 with the supporting shaft 7 in between. The first tubular portion 15 is provided on the inner side of the supporting shaft 7, and the second tubular portion 15 is on the outer side of the supporting shaft 7; and as seen from FIG. 5 the first tubular portion 15 has a round through-holes 15*a*, and the second tubular portion 16 has also a round through-hole 16*a*. The inner-side first tubular portion 15 (or the through-hole 15*a*) and the outer-side second tubular portion 16 (or the through-hole 16*a*) are parallel to each other, and these tubular portions are positioned in substantially the radial direction of the table 1.

Elongated holes 17 and 18 are, as seen from FIG. 3, respectively provided in the bottoms of the tubular portions 15 and 16 so as to extend in the direction of the length of the tubular portions, and linear protrusions (guides) 19 and 21 are, as seen from FIG. 5, formed on the left and right sides of the outer-side second tubular portion 16 so as to extend in the direction of the length.

Figure 2:
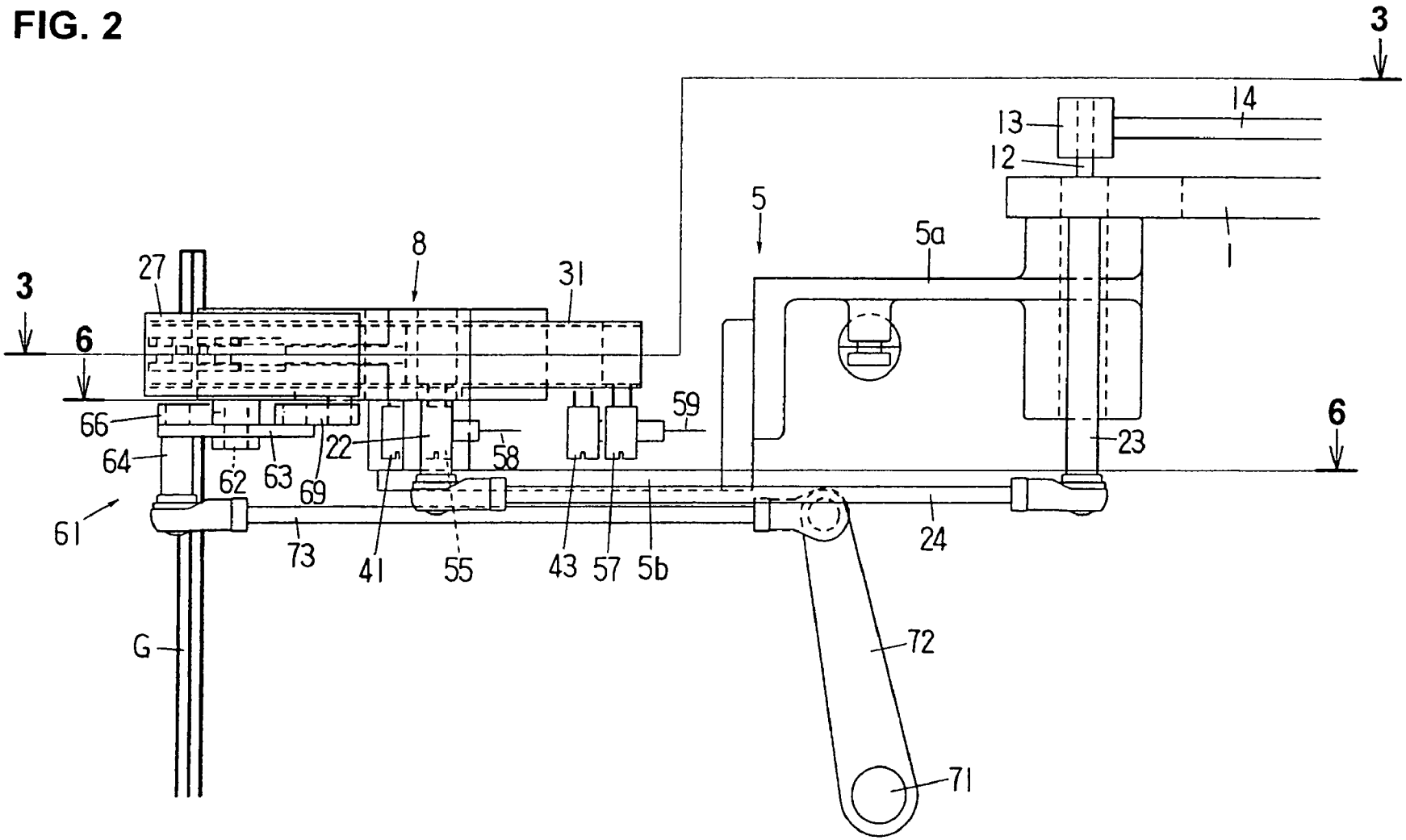
FIG. 2 is a front elevational view of the grippers (with the inside and outside chuck sections close to each other)

As shown in FIGS. 1 and 2, a pin 22 is provided so as to protrude from the bottom of each of one of the chuck holders 8, a pin 23 is provided so as to protrude from the bottom of table 1, and these two pins 22 and 23 are connected by a first linking rod 24 so that both ends of the rod 24 are rotatable at the pins 22 and 23 in the horizontal plane. A positional relationship is set up so that a parallelogram is constantly formed when the axis center of the supporting shaft 4 of the gripper arm 5 (or 6), the supporting shaft 7 of the chuck holder 8 and pins 22 and 23 are connected with imaginary straight lines in the horizontal plane. As a result, a type of parallel link mechanism is created by the supporting shafts 4 and 7 and pins 22 and 23 (or by the gripper arm 5 (6), chuck holder 8, first link rod 24, and table 1); and thus, a translational movement (parallel movement) always occurs in the chuck holders 8 when the gripper arms 5 and 6 make swing motions, and that attitude (orientation) of the chuck holders 8 does not change. Accordingly, the different first tubular portions 15 and 15 and the different second tubular portions 16 and 16 always maintain a parallel relationship to each other in the chuck holders 8 and 8 of the pair of gripper arms 5 and 6. As a result, when the distance between gripper arms 5 and 6 is adjusted for the close position and separate position to accommodate the changes in the gusset bag size (or the width of the bags) or when the gripper arms 5 and 6 are positioned between the close position and the separate position during the bag filling operations (before and after bag supply), the holding surfaces of the inside and outside chuck sections 2 and 3 can always remain parallel to the direction of the width of the bag.

Inside and Outside Chuck Sections and Chuck Open/Close Mechanisms

As shown in FIG. 1, the inside chuck section 2 of each one of the gripper arms 5 and 6 is comprised of an inside fixed chuck element 25 having a gripping surface facing inward and an inside movable chuck element 26 that grips a side edge (inside side-edge) of gusset bag G between itself and the inside fixed chuck element 25. The outside chuck section 3 of each one of the gripper arms 5 and 6 is comprised of an outside fixed chuck element 27 having a gripping surface facing outward and an outside movable chuck element 28 that grips a side edge (outside side-edge) of gusset bag G between itself and the outside fixed chuck element 27. Thus, the right-side gripper arm 5 grip one side (right-side) of the gusset bag G at two (inside and outside) locations by the inside chuck section 2 and out side chuck section 3, and the left-side gripper arm 6 grip another side (left-side) of the gusset bag G at two (inside and outside) locations by the inside chuck section 2 and outside chuck section 3.

Meanwhile, as primarily shown in FIGS. 3 and 5, in each one of the gripper arms 5 and 6, a first tubular member 29 is inserted into the through-hole 15*a* of the first tubular portion 15 of the chuck holder 8 such that it can slide freely, and a second tubular member 31 is inserted into the through-hole 16*a* of the second tubular portion 16 such that it can slide freely. The inside fixed chuck element 25 is affixed to the tip end of the first tubular member 29, and the outside fixed chuck element 27 is affixed to the tip end of the second tubular member 31. As best seen from FIG. 5, a groove 32 is formed on the inside fixed chuck element 25 side, and a groove 33 is formed on the outside fixed chuck element 27 side; and guides 19 and 21 of the chuck holder 8 are respectively fitted in the grooves 32 and 33 in a slidable fashion. With this structure, the rotation of the first and second tubular members 29 and 31 is prevented when these tubular members slide in the chuck holder 8 in the axial direction.

As seen from FIG. 3, the gripper (or each one of the chuck holders 8) is provided with an inside chuck open/close mechanism 34 for opening and closing the inside chuck section 2 and an outside chuck open/close mechanism 35 for opening and closing the outside chuck section 3.

The inside chuck open/close mechanism 34 is comprised of the above-described first tubular member 29 and a first air cylinder 36 installed within the tube body of the first tubular member 29. The inside movable chuck element 26 is installed at the tip end portion of the piston rod 37 of the first air cylinder 36, and this inside movable chuck element 26 is opened and closed with respect to the inside fixed chuck element 25 by the advance and retreat motions of the piston rod 37. The first tubular member 29 has a guide wall 38 formed at the tip end of the first tubular member 29, and the inside movable chuck element 26 advances and retreats by being guided by the inner peripheral surface of the hole formed in the guide wall 38.

The first air cylinder 36 is of a double-acting type. As seen from FIG. 4, a pipe joint 41 is screw-connected to one of the air outlets/inlets of the first air cylinder 36 through a hole 39 formed in the underside of the first tubular member 29 and an elongated hole 17 formed in the underside of chuck holder 8, and another pipe joint 43 is screw-connected to the other of the air outlet/inlets of the first air cylinder 36 through another hole 42 formed in the underside of the first tubular member 29. The pipe joints 41 and 43 are respectively connected to the air pipes 44 and 45 that are linked to a pressurized air supply source (not shown) via switching valves or the like (not shown).

The outside chuck open/close mechanism 35 is comprised of the above-described second tubular member 31, a second air cylinder 46 installed within the tube body of the second tubular member 31, and a link mechanism 48 that links the piston rod 47 of the second air cylinder 46 to the external movable chuck element 28. The external movable chuck element 28 is opened and closed with respect to the external fixed chuck 27 by the advance and retreat motions of the piston rod 47. The link mechanism 48 includes a link member 49, which is screw-connected to the tip end of the piston rod 47, and a link 53, which links the link member 49 to the external movable chuck element 28 via pins 51 and 52. The outside movable chuck element 28 is supported at its center by a supporting shaft 54 such that it is rotatable on the outside fixed chuck element 27, and the link 53 is linked at its one end to the tip end of the link member 49 by means of a pin 51 and at its other end to one end of the outside movable chuck element 28 by means of a pin 52. As a result, the outside movable chuck element 28 is rotated (opened and closed with respect to the outside fixed chuck element 27) about the supporting shaft 54 via the link mechanism 48 by the advance and retreat motions of the piston rod 47.

The second air cylinder 46 is also of a double-acting type. As seen from FIG. 2, a pipe joint 55 is screw-connected to one of the air outlets/inlets of the second air cylinder 46 through a hole 54 formed in the underside of the second tubular member 31 and an elongated hole 18 formed in the underside of the chuck holder 8, and another pipe joint 57 is screw-connected to the other of the air outlet/inlets of the second air cylinder 46 through another hole 56 formed in the underside of the second tubular member 31. The pipe joints 55 and 57 are respectively connected to the air pipes 58 and 59 that are linked to a pressurized air supply source (not shown) via switching valves or the like (not shown).

With the elongated holes 17 and 18 provided respectively in the first and second tubular portions 15 and 16 of the chuck holder 8 of each one of the gripper arms 5 and 6, the first tubular member 29 and the second tubular member 31 are respectively allowed to slide for a specified distance within the through-holes 15*a* and 16*a* of the first tubular portion 15 and second tubular portion 16.

Figure 6:
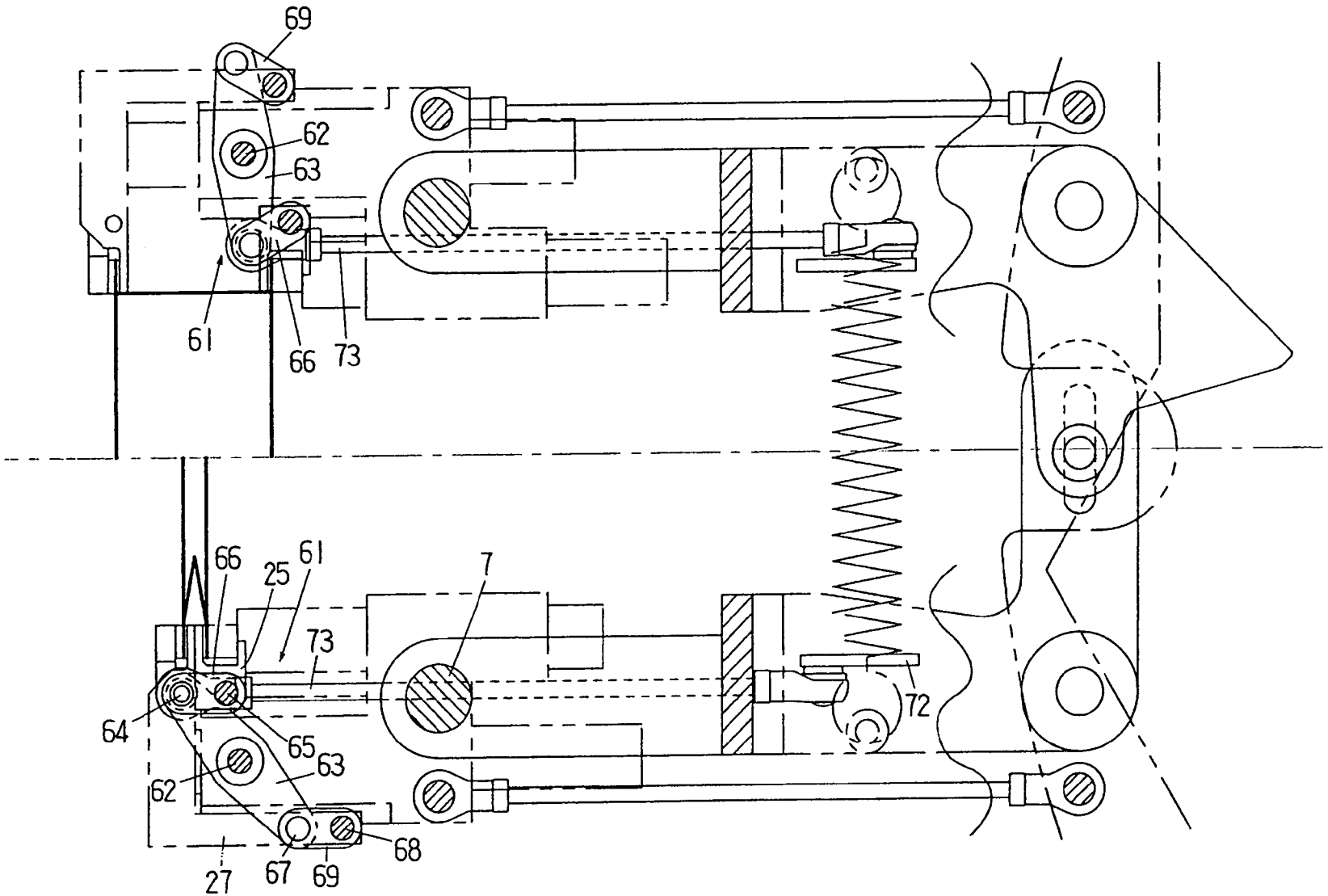
FIG. 6 is a cross-sectional view taken along the line 6-6 in FIG. 2 (the upper half shows that the inside and outside chuck sections (of the left-side check arm) are separated from each other, and the bottom half shows that the inside and outside chuck sections (of the right-side check arm) are close to each other)

Inside and Outside Chuck Positioning Mechanisms and Chuck Positioning Drive Mechanisms As primarily shown in FIG. 6, an inside and outside chuck positioning mechanism 61 is provided in each one of the gripper arms 5 and 6. The chuck positioning mechanism 61 moves the inside chuck section 2 and outside chuck section 3 toward inside and outside between the close position and the separate position.

More specifically, the inside and outside chuck positioning mechanism 61 is comprised of a swing lever 63 provided so that it can rotate freely in the horizontal plane on a supporting shaft 62 that protrude from the bottom of the chuck holder 8, a link 66 that links one end of the swing lever 63 to the inside fixed chuck element 25 via pins 64 and 65, and a link 69 that links the other end of the swing lever 63 to the outside fixed chuck element 27 via pins 67 and 68.

As parts of a chuck positioning drive mechanism that activates the inside and outside chuck positioning mechanism 61, the following parts are provided: a supporting shaft 71 (see FIG. 2) provided, under the table 1, on a mechanical element (not shown) that intermittently rotates along with the table 1, a pivot drive lever 72 affixed at its base end to the supporting shaft 71, and a second linking rod 73 that links the swing end of the pivot drive lever 72 to the bottom end of the pin 64 via a universal joint. A bias force is applied constantly to the pivot drive lever 72 so that the pivot drive lever 72 swings in the roughly outwardly radial direction of the table 1 (toward the left side in FIG. 2); and with this bias force, the swing lever 63 is swung about the supporting shaft 62, so that the inside chuck section 2 and the outside chuck section 3 are moved to come close to a close position (so that the back of the inside fixed chuck element 25 and the back of the outside fixed chuck element 27 are bought to come into contact with each other). On the other hand, the supporting shaft 71 rotates according to a designated timing by means of a drive transmission mechanism such as a cam in accordance with the intermittent rotation of the table 1; and when the pivot drive lever 72 swings a prescribed angle in the opposite direction (toward the right side in FIG. 2), the inside chuck section 2 and the outside chuck section 3 are moved to apart from each other to a separate position. In FIG. 6, the lower half shows that the inside chuck section 2 and the outside chuck section 3 are in the close position, and the upper half shows that the inside chuck section 2 and the outside chuck section 3 are in the separate position.

In an intermittently rotating table type bag filling apparatus equipped with the above-described grippers, the timing of the actions of the grippers (opening and closing of the gripper arms 5 and 6, opening and closing and moving to close and apart of the inside and outside chuck sections 2 and 3, and so on) in accordance with the intermittent rotation of the table 1, and the actions of the various devices provided at different process positions on the periphery of the table 1, and so on are the same as disclosed in Japanese Patent Application Laid-Open (Kokai) No. 2007-210645, and the description is omitted here.

Several additional points and other embodiments will be described below with respect to the advantages and functions of the above-described grippers.

(1) In the above-described grippers, the air cylinders 36 and 46 are employed as the drive source for the inside chuck open/close mechanisms 34 and outside chuck open/close mechanisms 35; and as a result, those mechanisms are simpler in structure than the grippers described in Japanese Patent Application Laid-Open (Kokai) No. 2007-210645. Since the inside and outside chuck sections 2 and 3 of each one of the gripper arms 5 and 6 of a pair of grippers are opened and closed by the actions of the switching valves at any position during one rotation of the table 1, it is easy to change the process positions that involve, among others, opening and closing of the chuck sections and adding re-holding and weighing processes, and extra design changes and modification works for opening and closing actions of the inside and outside chuck sections 2 and 3 are not required. Also, by adjusting the pressure of the air supplied to the air cylinders 36 and 46, the gripping force of the inside and outside chuck sections 2 and 3 can be easily changed.

In addition, in the above-described grippers, the actuation parts (the air cylinders 36 and 46 and the link mechanisms 48) of the inside and outside chuck open/close mechanism 34 and 35 can be housed within the tube bodies of the first and second tubular members 29 and 31 of the chuck holder 8. Accordingly, the surrounding of the gripper arms 5 and 6 is cleared, providing excellent cleaning and maintenance characteristics.

(2) Furthermore, in the above-described grippers, the double-acting air cylinders 36 and 46 are used. However, single-acting air cylinders can be used instead. When a single-acting air cylinder is used, a piston rod that has moved in one direction by air pressure is returned in the opposite direction by, for example, the bias force of a spring; and thus it is desirable to design it so that pressure by the air cylinders is used when closing the inside and outside movable chuck element 26 and 28 and spring bias force is used when opening the inside and outside movable chuck elements 26 and 28. This is because this setting facilitates adjustment of the gripping force of the inside and outside chuck sections 2 and 3. In this case, it is also desirable that the above-described spring be also installed within the tube bodies of the first and second tubular members 29 and 31. However, in a single-acting air cylinder, the piston rod tends not to return properly if the spring has insufficient strength, and air pressure that is high as much as the strength of the spring is (further) required in order to produce the required gripping force; accordingly, it is desirable to use a double-acting air cylinder.

(3) In the above-described grippers, the guides 19 and 21 formed on the second tubular portion 16 (see FIG. 5) are fitted in the grooves 32 and 33 formed respectively on the inside fixed chuck element 25 and outside fixed chuck element 27 so that the guides 19 and 21 can slide freely along the grooves 32 and 33. It is also possible to design so that the through-holes 15*a* and 16*a* of the first and second tubular portions 15 and 16 of the chuck holders 8 are formed square (they are round in the above-described embodiment), and the external shapes of the first and second tubular members 29 and 31 are formed square as well so as to correspond to the square through-holes 15*a* and 15*b*. With this setting, the first and second tubular members 29 and 31 can make their forward and backward sliding motions within the through-holes 15*a* and 16*a* without making rotation; and thus in this setting, the guides 19 and 21 and grooves 32 and 33 are not required.

Further, in the above-described grippers, the chuck holder 8 includes the first and second tubular portions 15 and 16, and the first and second tubular members 29 and 31 are inserted in the through-holes 15*a* and 16*a* of the tubular portions 15 and 16 so that the tubular members 29 and 31 are supported in the through-holes 15*a* and 16*a* and make forward (outward) and backward (inward) sliding motions therein. However, the manner of installing the first and second tubular members 29 and 31 in the chuck holder 8 is indeed not limited to this structure.

(4) In the above-described grippers, when the piston rods 37 and 47 advance (or move outward), the inside movable chuck element 26 and the outside movable chuck element 28 are closed; and when the piston rods 37 and 47 retreat (or move inward), the inside movable chuck element 26 and the outside movable chuck element 28 are opened. However, the opening and closing actions of the inside and outside movable elements 26 and 28 which are made by the advance and retreat motions of the piston rods 37 and 47 can be set opposite.

In addition, through the above-described grippers are used in an intermittently rotating table type bag filling apparatus, the grippers of the present invention can be used in, for instance, a continuously rotating table type bag filling apparatus, in a bag filling apparatus in which a chain that rotates along a circular path is adapted to be the transportation member (see, for example, Japanese Utility Model Application Laid-Open (Kokai) No. S55-90506 and Japanese Patent Application Laid-Open (Kokai) No. 2002-302227 though which is not for gusset bags), or in a horizontal-type bag filling apparatus in which the bags are, when transported, on their side and not being suspended vertically and the filling operation is performed during the transport process (see, for example, Japanese Patent Application Laid-Open (Kokai) No. H6-144403 though which is not for gusset bags).

Figure 7:
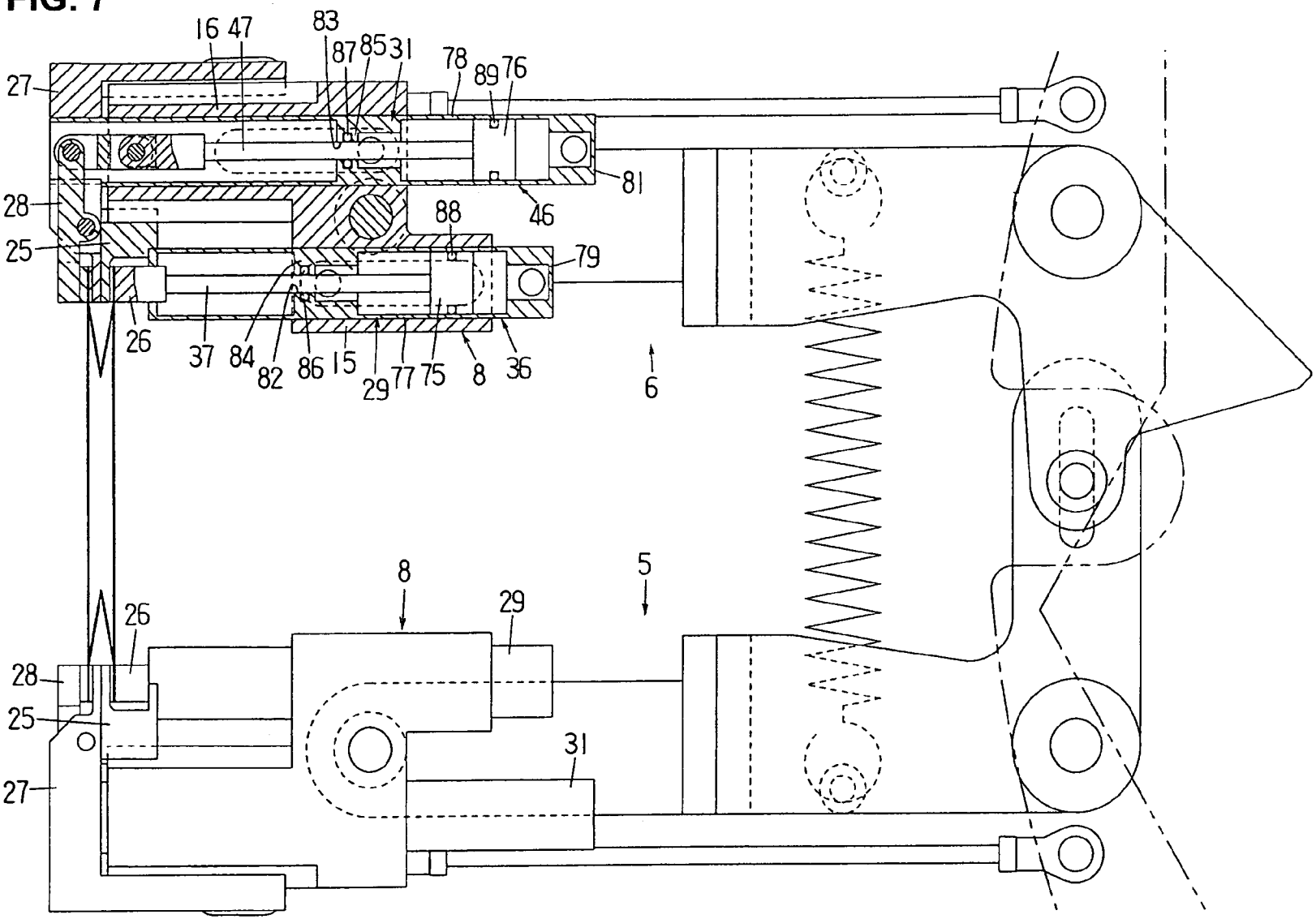
FIG. 7 is a partially cross-sectional top view of the grippers according to another example of the present invention (only the left-side gripper (shown in the upper half in FIG. 7) being shown in cross-section).

FIG. 7 shows another type of grippers according to the present invention. In the grippers of FIG. 7, parts that are essentially the same as those of the grippers shown in FIGS. 1 through 6 are given the same reference numerals.

The gripper shown in FIG. 7 differs from the gripper shown in FIGS. 1 through 6 in that the first and second tubular members 29 and 31 are used as the cylinder tubes of the air cylinders 36 and 46; and the other elements are essentially the same as those of the gripper of FIGS. 1 through 6.

More specifically, as seen from FIG. 7, the pistons 75 and 76 of the respective air cylinders 36 and 46 are provided so that they slide forward and backward within the tube bodies of the first and second tubular members 29 and 31 (or within the cylinder tubes 77 and 78) of each one of the gripper arms 5 and 6 of a pair of grippers. The rear ends of the first and second tubular members 29 and 31 are closed by the rear walls 79 and 81; and separating walls 84 and 85 that have holes 82 and 83 through which the piston rods 37 and 47 respectively pass are provided in the middle portions of the first and second tubular members 29 and 31, and O-rings 86 and 87 are respectively installed between the piston rods 37 and 47 and the holes 82 and 83 to seal the holes 82 and 83.

Furthermore, two air outlets/inlets (threaded holes) are formed in the tubular wall (wall of the cylinder tube 77) so that they are located between the rear wall 79 and the separating wall 84 of the first tubular member 29, and also two air outlets/inlets (threaded holes) are formed in the tubular wall (the wall of the cylinder tube 78) so that they are located between the rear wall 81 and the separating wall 85 of the second tubular member 31. Pipe joints 41 and 43 (see FIG. 2) for supplying pressurized air are screw-connected to the air outlets/inlets (threaded holes) of the first tubular member 29 and pipe joints 55 and 57 (see FIG. 2) for supplying pressurized air are screw-connected to the air outlets/inlets (threaded holes) of the first tubular member 31.

The connection between the tip end of the piston rod 37 and the inside movable chuck element 26 and the connection between the tip end of the piston rod 47 and the outside movable chuck element 28 are the same as those shown in FIGS. 1 through 6. The reference numerals 88 and 89 are O-rings.

As seen from the above, in the gripper shown in FIG. 7, the first and second tubular members 29 and 31 are used as (or serve as) the cylinder tubes 77 and 78 of the air cylinders 36 and 46. Accordingly, the number of parts is reduced, and the structure is simplified.

The invention claimed is:

1. A gripper for an automatic bag filling apparatus wherein a plurality of pairs of grippers are provided at equal intervals around a periphery of a transportation member that rotates continuously or intermittently, and said plurality of pairs of grippers respectively grip a gusset bag at two locations on either side edge thereof and are rotated along a predetermined circular path together with said transportation member;

each pair of said grippers being comprised of:

a pair of left and right gripper arms swingably mounted on said transportation member, chuck holders rotatably mounted respectively on the gripper arms and are moved in parallel when said gripper arms make a swing motion so that a space between the chuck holders is narrowed and widened, inside chuck sections and outside chuck sections provided in the tip end portions of the chuck holders so to face each other, an inside chuck open/close mechanism and an outside chuck open/close mechanism provided in each one of the chuck holders and respectively open and close said inside and outside chuck sections, and an inside/outside chuck positioning mechanism provided in each one of the chuck holders and moves the inside chuck section and outside chuck section inwardly and outwardly between a close position and a separate position; and wherein said inside chuck section comprises an inside fixed chuck element, having a gripping surface facing inward, and an inside movable chuck element, so that said inside fixed and movable chuck elements grip one of the two locations on the side edge of the gusset bag in between, and said outside chuck section comprises an outside fixed chuck element, having a gripping surface facing outward, and an outside movable chuck element, so that said outside fixed and movable chuck elements grip another one of the two locations on the side edge of the gusset bag in between; and wherein said inside chuck open/close mechanism is comprised of:

a first tubular member slidably provided within each of said chuck holders, and a first air cylinder installed within a tube body of said first tubular member; and said inside movable chuck element which is affixed to a tip end of said first tubular member is opened and closed with respect to said inside fixed chuck element by advance and retreat motions of a piston rod of said first air cylinder; and said outside chuck open/close mechanism is comprised of:

a second tubular member slidably provided within said each of said chuck holders, and a second air cylinder installed within a tube body of said second tubular member, and said outside movable chuck element which is affixed to a tip end of said second tubular member is opened and closed with respect to said outside fixed chuck element by advance and retreat motions of a piston rod of said second air cylinder.

2. A gripper for an automatic bag filling apparatus wherein a plurality of pairs of grippers are provided at equal intervals around a periphery of a transportation member that rotates continuously or intermittently, and said plurality of pairs of grippers respectively grip a gusset bag at two locations on either side edge thereof and are rotated along a predetermined circular path together with said transportation member;

each pair of said grippers being comprised of:

a pair of left and right gripper arms swingably mounted on said transportation member, chuck holders rotatably mounted respectively on the gripper arms and are moved in parallel when said gripper arms make a swing motion so that a space between the chuck holders is narrowed and widened, inside chuck sections and outside chuck sections provided in the tip end portions of the chuck holders so to face each other, an inside chuck open/close mechanism and an outside chuck open/close mechanism provided in each one of the chuck holders and respectively open and close said inside and outside chuck sections, and an inside/outside chuck positioning mechanism provided in each one of the chuck holders and moves the inside chuck section and outside chuck section inwardly and outwardly between a close position and a separate position; and wherein said inside chuck section comprises an inside fixed chuck element, having a gripping surface facing inward, and an inside movable chuck element, so that said inside fixed and movable chuck elements grip one of the two locations on the side edge of the gusset bag in between; and said outside chuck section comprises an outside fixed chuck element, having a gripping surface facing outward, and an outside movable chuck element, so that said outside fixed and movable chuck elements grip another one of the two locations on the side edge of the gusset bag in between; and wherein said inside chuck open/close mechanism is comprised of:

a first tubular member slidably provided within each of said chuck holders, and a first air cylinder that uses said first tubular member as a cylinder tube thereof; and said inside movable chuck element which is affixed to a tip end of said first tubular member is opened and closed with respect to said inside fixed chuck element by advance and retreat motions of a piston rod of said first air cylinder; and said outside chuck open/close mechanism is comprised of:

a second tubular member slidably provided within said each of said chuck holders, and a second air cylinder that uses said second tubular member as a cylinder tube thereof, and said outside movable chuck element which is affixed to a tip end of said second tubular member is opened and closed with respect to said outside fixed chuck element by advance and retreat motions of a piston rod of said second air cylinder.

3. The grippers for an automatic bag filling apparatus according to claim 1 or 2, wherein each of said chuck holders has a first tubular portion and a second tubular portion, said first tubular member is slidably provided within said first tubular portion, and said second tubular member is slidably provided within said second tubular portion.

4. The grippers for automatic bag filling apparatus according to claim 3, wherein said air cylinder is a double-acting air cylinder.

5. The gripper for an automatic bag filling apparatus according to claim 4, wherein said transportation member is an intermittently rotating table, and said grippers grip the gusset bag in a hanging state; and wherein during one rotation of said table, a gusset bag is supplied to said grippers, and a filling process including opening of a bag mouth and filling of the bag with contents is performed sequentially for the gusset bag gripped by said grippers.

6. The gripper for an automatic bag filling apparatus according to claim 3, wherein said transportation member is an intermittently rotating table, and said grippers grip the gusset bag in a hanging state; and wherein during one rotation of said table, a gusset bag is supplied to said grippers, and a filling process including opening of a bag mouth and filling of the bag with contents is performed sequentially for the gusset bag gripped by said grippers.

7. The grippers for automatic bag filling apparatus according to claim 1 or 2, wherein said air cylinder is a double-acting air cylinder.

8. The gripper for an automatic bag filling apparatus according to claim 7, wherein said transportation member is an intermittently rotating table, and said grippers grip the gusset bag in a hanging state; and wherein during one rotation of said table, a gusset bag is supplied to said grippers, and a filling process including opening of a bag mouth and filling of the bag with contents is performed sequentially for the gusset bag gripped by said grippers.

9. The gripper for an automatic bag filling apparatus according to claim 1 or 2, wherein said transportation member is an intermittently rotating table, and said grippers grip the gusset bag in a hanging state; and wherein during one rotation of said table, a gusset bag is supplied to said grippers, and a filling process including opening of a bag mouth and filling of the bag with contents is performed sequentially for the gusset bag gripped by said grippers.

* * * * *